US008049590B2

(12) United States Patent
Huh et al.

(10) Patent No.: US 8,049,590 B2
(45) Date of Patent: Nov. 1, 2011

(54) INVERTER TRANSFORMER

(75) Inventors: Dong Young Huh, Gyeonggi-do (KR); Shin Cho, Gyeonggi-do (KR)

(73) Assignee: LG Innotek Co., Ltd., Seoul (KR)

( * ) Notice: Subject to any disclaimer, the term of this patent is extended or adjusted under 35 U.S.C. 154(b) by 42 days.

(21) Appl. No.: 12/667,605

(22) PCT Filed: Jun. 25, 2008

(86) PCT No.: PCT/KR2008/003619

§ 371 (c)(1),
(2), (4) Date: Jan. 4, 2010

(87) PCT Pub. No.: WO2009/005243

PCT Pub. Date: Jan. 8, 2009

(65) Prior Publication Data

US 2011/0006869 A1 Jan. 13, 2011

(30) Foreign Application Priority Data

Jul. 4, 2007 (KR) ..... 10-2007-0067293

(51) Int. Cl.
*H01F 27/30* (2006.01)

(52) U.S. Cl. ..... 336/208; 336/198; 336/192; 336/212

(58) Field of Classification Search ..... 336/208, 336/198, 192
See application file for complete search history.

(56) References Cited

U.S. PATENT DOCUMENTS

| | | | | |
|---|---|---|---|---|
| 5,227,745 | A * | 7/1993 | Oda et al. | 333/177 |
| 7,423,510 | B2 * | 9/2008 | Ger et al. | 336/208 |
| 2003/0080844 | A1 * | 5/2003 | Nishikawa et al. | 336/178 |
| 2008/0088403 | A1 * | 4/2008 | Suzuki et al. | 336/198 |
| 2009/0278646 | A1 * | 11/2009 | Chen et al. | 336/177 |

FOREIGN PATENT DOCUMENTS

| | | | |
|---|---|---|---|
| JP | 08-138950 | | 5/1996 |
| KR | 10-2005-0037628 | A | 4/2005 |
| KR | 10-0631125 | B1 | 9/2006 |
| KR | 10-2007-0000046 | A | 1/2007 |

* cited by examiner

*Primary Examiner* — Anh Mai
(74) *Attorney, Agent, or Firm* — Saliwanchik, Lloyd & Eisenschenk

(57) ABSTRACT

An embodiment provides an inverter transformer comprising: a first bobbin around which a first coil is wound, the first bobbin comprising a first through hole; a second bobbin around which a second coil is wound, the second bobbin comprising a second through hole; a spacer between the first and the second bobbins; and a core inserted into the first and the second through holes.

18 Claims, 2 Drawing Sheets

[Fig. 1]
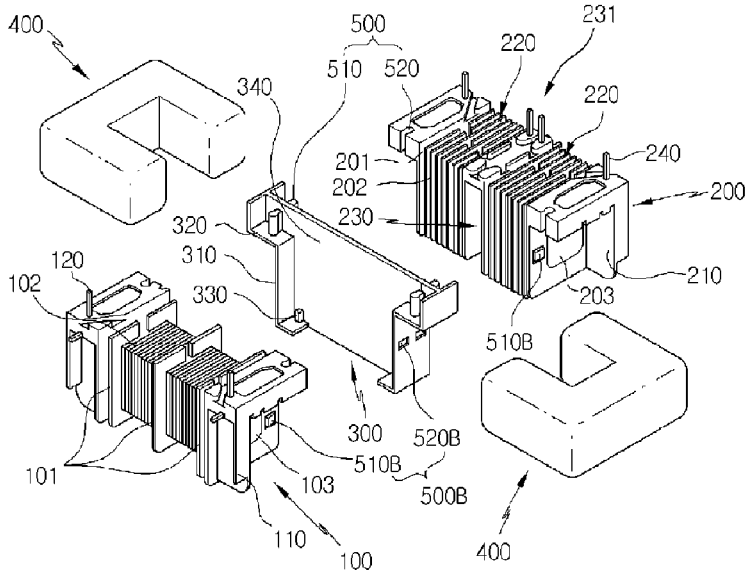
[Fig. 2]
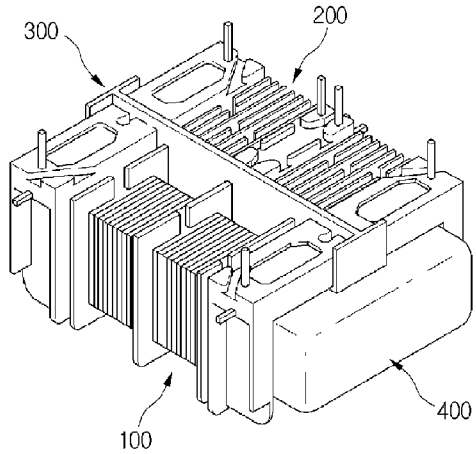
[Fig. 3]
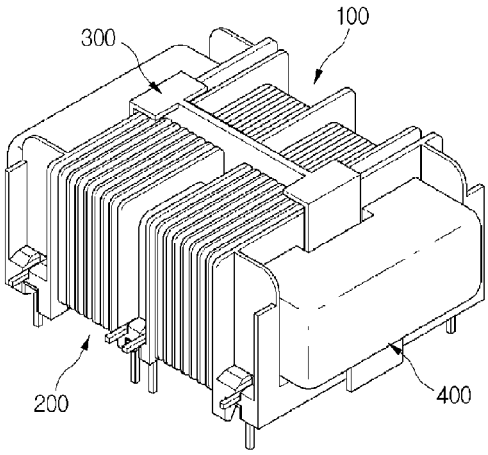

[Fig. 4]
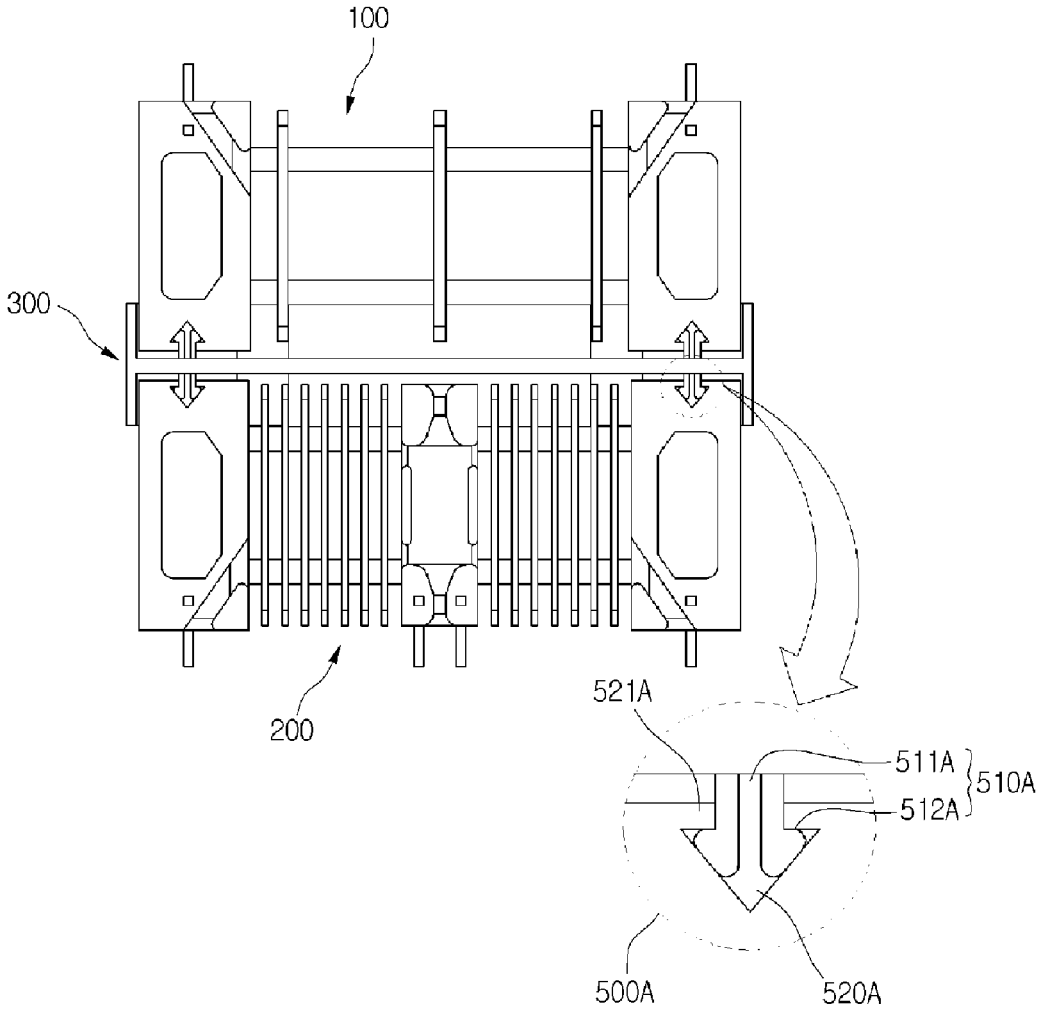

INVERTER TRANSFORMER

CROSS-REFERENCE TO RELATED APPLICATIONS

This application is the U.S. national stage application of International Patent Application No. PCT/KR2008/003619, filed Jun. 25, 2008, which claims priority to Korean Application No. 10-2007-0067293, filed Jul. 4, 2007, the disclosures of each of which are incorporated herein by reference in their entirety.

TECHNICAL FIELD

The present disclosure relates to an inverter transformer.

BACKGROUND ART

Liquid crystal display devices are widely applied to computers and various display devices. Such a liquid crystal display device comprises a liquid crystal panel, a backlight unit having a high-voltage driven lamp, and an inverter for driving the lamp. The inverter for driving the lamp comprises a transformer for isolation and step-up. This transformer is referred to as an inverter transformer that steps up applied voltage for supplying the voltage to the lamp.

Due to a recent trend of large-sized display devices, the capacitance of an inverter transformer provided to an inverter becomes larger to generate a large amount of heat. In the case where heat is not efficiently dissipated, the transform efficiency of the inverter transformer is degraded.

Thus, there is an increasing demand for methods of effectively dissipating heat generated from the inverter transformer.

DISCLOSURE OF INVENTION

Technical Problem

Embodiments provide an inverter transformer capable of improving the transform efficiency by effectively dissipating generated heat to the outside.

Technical Solution

An embodiment provides an inverter transformer comprising: a first bobbin around which a first coil is wound, the first bobbin comprising a first through hole; a second bobbin around which a second coil is wound, the second bobbin comprising a second through hole; a spacer between the first and the second bobbins; and a core inserted into the first and the second through holes.

An embodiment provides an inverter transformer comprising: a first bobbin around which a first coil is wound, the first bobbin comprising a first through hole; a second bobbin around which a second coil is wound, the second bobbin comprising a second through hole; a spacer between the first and the second bobbins, the spacer comprising: side supports supporting both sides of the first and the second bobbins; and a coupling member coupled to the first and the second bobbins; and a core inserted into the first and the second through holes.

An embodiment provides an inverter transformer comprising: a first bobbin around which a first coil is wound, the first bobbin comprising a first through hole; a second bobbin around which a second coil is wound, the second bobbin comprising a second through hole; a spacer between the first and the second bobbins, the spacer comprising: a coupling member coupled to the first and the second bobbins; and space protrusions providing an insulation creepage distance for the first and the second bobbins; and a core inserted into the first and the second through holes.

Advantageous Effects

According to embodiments, an inverter transformer can improve the transform efficiency by effectively dissipating generated heat to the outside.

BRIEF DESCRIPTION OF THE DRAWINGS

FIG. 1 is an exploded perspective view illustrating an inverter transformer according to an embodiment.

FIG. 2 is a perspective view illustrating an inverter transformer according to an embodiment.

FIG. 3 is a perspective view illustrating a bottom portion of an inverter transformer according to an embodiment.

FIG. 4 is a perspective view illustrating a coupling member of an inverter transformer according to an embodiment.

MODE FOR THE INVENTION

Reference will now be made in detail to the embodiments of the present disclosure, examples of which are illustrated in the accompanying drawings.

FIG. 1 is an exploded perspective view illustrating an inverter transformer according to an embodiment; FIG. 2 is a perspective view illustrating the inverter transformer according to an embodiment; and FIG. 3 is a perspective view illustrating a bottom portion of the inverter transformer according to an embodiment.

The inverter transformer according to the embodiments comprises a first bobbin 100, a second bobbin 200, a spacer 300, and cores 400.

The first bobbin 100 comprises a plurality of insulation slits 101, a wound first coil 102 disposed between the insulation slits 101, and a first through hole 103 disposed in the middle thereof.

The second bobbin 200 comprises a plurality of insulation slits 201, a wound second coil 202 disposed between the insulation slits 201, a second through hole 203 disposed in the middle thereof. And the second bobbin 200 comprises two output portions 220.

The separate spacer 300 is provided between the first and the second bobbins 100 and 200. The spacer 300 provides an insulation distance between the first and the second bobbins 100 and 200. The separate spacer 300 is provided between surfaces of the first and the second bobbins 100 and 200 facing with each other.

The cores 400 are inserted into the first through hole 103 of the first bobbin 100 and the second through hole 203 of the second bobbin 200. The cores 400 each may have a U-shape.

The spacer 300 spaces the first bobbin 100 apart from the second bobbin 200 to certainly provide the electrical insulation between the wound first coil 102 and the wound second coil 202. Thus, an additional distance is not required to insulate the wound first coil 102 and the wound second coil 202, thus preventing the decrease in winding area.

The first and the second bobbins 100 and 200 are exposed out of the spacer 300 to provide a intrinsic solution to a heat problem. The upper and lower surfaces of the first and the second bobbins 100 and 200 are exposed to the outside. Except for surfaces of the first and the second bobbins 100 and 200 contacting the spacer 300, the other surfaces are also exposed to the outside. Thus, the inverter transformer can be used as a high-capacity inverter transformer.

According to the embodiments, the first and the second bobbins 100 and 200 are disposed on both sides of the spacer 300, respectively. The cores 400 are inserted into the first and the second through holes 103 and 203. Thus, the cores 400 fix the first and the second bobbins 100 and 200.

The inverter transformer according to the embodiments may comprise coupling members 500 to maintain the coupling of the spacer 300 to the first bobbin 100 and the coupling of the spacer 300 to the second bobbin 200.

For example, the coupling member 500 may comprise coupling protrusions 510 and coupling holes 520. The coupling holes 520 may be provided to the first and the second bobbins 100 and 200. The coupling holes 520 may be provided to the surfaces of the first and the second bobbins 100 and 200 facing the spacer 300. The coupling protrusions 510 may be provided to the spacer 300. The coupling protrusions 510 may be provided to surfaces of the spacer 300 facing the first and the second bobbins 100 and 200 and correspond to the coupling holes 520. The first and the second bobbins 100 and 200 and the spacer 300 can be fixed and spaced apart from each other by the coupling of the coupling protrusions 510 to the coupling holes 520.

The inverter transformer according to the embodiments may comprise space protrusions 330, in which the space protrusions 330 may be provided to a lower end of the spacer 300. The space protrusions 330 space the first and the second bobbins 100 and 200 apart from a lower portion of the spacer 300. Thus, the space protrusion 330 secures a creepage distance below the surfaces of the first and the second bobbins 100 and 200 facing with each other.

As such, according to the embodiments, the coupling members 500 and the space protrusions 330 space the first and the second bobbins 100 and 200 apart from the spacer 300 in lower and upper portions.

Also, the coupling members 500 and the space protrusions 330 maintain the first and the second through holes 103 and 203 of the first and the second bobbins 100 and 200 in predetermined positions to allow the cores 400 to be easily inserted into the first and the second through holes 103 and 203.

For example, the coupling protrusion 510 and the coupling hole 520 may have a cylindrical shape. The coupling of the coupling protrusion 510 to the coupling hole 520 prevents the release of the first and the second bobbins 100 and 200 from the spacer 300. The coupling protrusion 510 may be formed of a soft material. Thus, the coupling protrusion 510 can be horizontally press-fit coupled to the coupling hole 520. Alternatively, the coupling protrusion 510 may be vertically inserted and coupled to the coupling hole 520. The shapes of the coupling protrusion 510 and the coupling hole 520 are not limited to the cylindrical shape, and various modifications for stable coupling can be made therein.

FIG. 4 is a perspective view illustrating a coupling member of an inverter transformer according to an embodiment.

Referring to FIG. 4, coupling members 500A each comprises a coupling protrusion 510A and a coupling hole 520A. Fixing portions 521A are provided to both sides of the coupling hole 520A. The coupling protrusion 510A comprises a dividing portion 511A in the middle thereof, and engaging protrusions 512A. The engaging protrusions 512A are provided at positions corresponding to those of the fixing portions 521A and are provided on both sides of the dividing portion 511A.

The coupling member 500A is locked by horizontally pushing the coupling protrusion 510A into the coupling hole 520A. As inclined surfaces of the engaging protrusions 512A slide along the fixing portions 521A, the dividing portion 511A allows the engaging protrusions 512A to be closed and inserted into the coupling hole 520A. The inserted engaging protrusions 512A engage with and stably fixed to the fixing portions 521A.

According to the embodiment, coupling members 500B may be provided besides the coupling members 500 and 500A. The coupling member 500B may comprise an elastic element 510B and a fitting hole 520B.

The fitting holes 520B may be provided to side supports 310 of the spacer 300, and the elastic elements 510B may be provided to portions of the first and the second bobbins 100 and 200 corresponding to the fitting holes 520B. Thus, the elastic element 510B is inserted into and fixed to the fitting hole 520B. The positions of the elastic elements 510B and the fitting holes 520B are not limited to the sides of the spacer 300 and the first and the second bobbins 100 and 200 and may be provided to other positions allowing the elastic elements 510B to be fixed to the fitting holes 520B.

According to the embodiments, the coupling members 500, 500A, and 500B may be selectively or collectively used as necessary. That is, at least one of the coupling members 500, 500A, and 500B may be provided.

First and second ribs 110 and 210 may be provided to the both sides of the first and the second bobbins 100 and 200 and surfaces corresponding to the spacer 300. The first and second ribs 110 and 210 are provided to secure a creepage distance between the both sides of the first and the second bobbins 100 and 200 and the first and the second through holes 103 and 203.

Such a creepage distance is the shortest distance between two conductive parts, which is measured along the surface of an insulation disposed between the conductive portions.

As such, since the enough creepage distance is secured, a predetermined additional distance for insulating is not required, so that the winding area is increased and window utilization factor becomes higher.

The side supports 310 may be provided to the spacer 300 in order to support the both sides of the first and the second bobbins 100 and 200. Supports 320, supporting lower ends of the first and the second bobbins 100 and 200, may be provided to an upper end of the side support 310. Thus, the supports 320 together with the coupling members 500, 500A, and 500B more stably fix the spacer 300 and the first and the second bobbins 100 and 200.

A plurality of pins 120 and 240 may be provided to outer surfaces of the first and the second bobbins 100 and 200 to fix the wound first and the wound second coils 102 and 202, thus preventing the movement of the inverter transformer after the installing of the inverter transformer.

An output portion separation end 230 is provided in the middle of the second bobbin 200. An input terminal 231 may be provided to the output portion separation end 230. The output portion separation end 230 can separate the two output portions 220 around which the second coil 202 is wound. Thus, two outputs can be obtained using the single transformer, thus achieving the effect corresponding to two transformers in a narrow area.

The core 400 may be provided in a pair and have a U-shape in a bilateral symmetry. According to the embodiments, since the cores 400 may be provided in a bilateral symmetry, the cores 400 can prevent defective assembly, thus improving the workability of a process of manufacturing the transformer.

According to the embodiments, the first and the second bobbins 100 and 200 are fixed to the both sides of the spacer 300 through the coupling members 500, 500A, and 500B.

Then, the cores 400 from the both sides are inserted into the first and the second through holes 103 and 203 of the first and the second bobbins 100 and 200, so that the inverter transformer is assembled.

The inverter transformer according to the embodiments comprises the side supports 310 to support the both sides of the first and the second bobbins 100 and 200 and secure the sufficient creepage distance. Also, a partition 340 of the spacer 300 can secure both the clearance distance and the creepage distance.

The inverter transformer according to the embodiments may be applied to various display devices comprising liquid crystal display devices.

Any reference in this specification to "one embodiment", "an embodiment", "example embodiment" etc., means that a particular feature, structure, or characteristic described in connection with the embodiment is comprised in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

The inverter transformer according to the embodiments can improve the transform efficiency by effectively dissipating generated heat to the outside.

The invention claimed is:

1. An inverter transformer comprising:

a first bobbin around which a first coil is wound, the first bobbin comprising a first through hole;

a second bobbin around which a second coil is wound, the second bobbin comprising a second through hole;

a spacer between the first and the second bobbins; and a core inserted into the first and the second through holes;

wherein the second bobbin comprises an output portion separtion end and two output portions separated by the output portion separation end.

2. The inverter transformer according to claim 1, wherein the core has a U-shape.

3. The inverter transformer according to claim 1, comprising a coupling member for coupling the first and the second bobbins to the spacer.

4. The inverter transformer according to claim 3, wherein the coupling member comprises:

coupling holes in the first and the second bobbins; and coupling protrusions on the spacer, the coupling protrusions being coupled to the coupling holes.

5. The inverter transformer according to claim 4, wherein the coupling holes are provided to surfaces located where the first and the second bobbins and the spacer face each other.

6. The inverter transformer according to claim 4, wherein the coupling holes and the coupling protrusions each has a cylindrical shape.

7. The inverter transformer according to claim 4, wherein the coupling hole comprises fixing portions on both sides thereof, and the coupling protrusion comprises: a dividing portion in a middle thereof;

and engaging protrusions on both sides of the dividing portion, the engaging protrusions being disposed at positions corresponding to positions of the fixing portions.

8. The inverter transformer according to claim 3, wherein the coupling member comprises:

fitting holes in the first and the second bobbins; and elastic elements on the spacer, the elastic elements being coupled to the fitting holes.

9. The inverter transformer according to claim 1, wherein the first and the second bobbins comprise ribs on both sides adjacent to surfaces corresponding to the spacer so that the ribs provide an insulation distance between opposite ends coupled to the spacer and the first and the second through holes.

10. The inverter transformer according to claim 1, wherein the spacer comprises side supports supporting both sides of the first and the second bobbins.

11. The inverter transformer according to claim 10, wherein the spacer comprises supports on upper ends of the side supports, the supports supporting lower ends of the first and the second bobbins.

12. The inverter transformer according to claim 1, wherein the first through hole is provided in a middle of the first bobbin, and the second through hole is provided in a middle of the second bobbin.

13. The inverter transformer according to claim 1, wherein the first and the second through holes are parallel with each other.

14. The inverter transformer according to claim 1, wherein the spacer is provided between surfaces of the first and the second bobbins facing each other to provide an insulation distance between the first and the second bobbins.

15. The inverter transformer according to claim 1, comprising space protrusions on a lower end of the spacer, the space protrusions providing an insulation creepage distance between the first and the second bobbins and the lower end of the spacer.

16. The inverter transformer according to claim 1, wherein the first bobbin comprises a plurality of insulation slits, and the first coil is wound between the insulation slits.

17. The inverter transformer according to claim 1, wherein the first and the second bobbins have upper surfaces, lower surfaces, and side surfaces not contacting the spacer, which are exposed to an outside to dissipate heat.

18. An inverter transformer comprising:

a first bobbin around which a first coil is wound, the first bobbin comprising a first through hole;

a second bobbin around which a second coil is wound; the second bobbin comprising a second through hole;

a spacer between the first and the second bobbins, the spacer comprising: a coupling member coupled to the first and the second bobbins; and space protrusions providing an insulation creepage distance for the first and the second bobbins; and a core inserted into the first and the second through holes.

* * * * *